US005312459A

United States Patent [19]

Sprugel et al.

[11] Patent Number: 5,312,459

[45] Date of Patent: May 17, 1994

[54] ADDITIVE FOR LIQUEFIED-GAS FUELS

[76] Inventors: Friedrich A. Sprugel, Solalindenstrasse 36b, D-8000 Munchen 82; Werner Angerer, Keltenstrasse 21, D-8029 Sauerlach, both of Fed. Rep. of Germany

[21] Appl. No.: 928,668

[22] Filed: Aug. 17, 1992

Related U.S. Application Data

[63] Continuation of Ser. No. 556,729, Jul. 25, 1990, abandoned.

[30] Foreign Application Priority Data

Jul. 25, 1989 [DE] Fed. Rep. of Germany ..... 3924596

[51] Int. Cl.[5] ..... C10L 1/22

[52] U.S. Cl. ..... 44/334; 44/340; 44/412; 44/418; 44/432

[58] Field of Search ..... 44/334, 340, 412, 418, 44/432

[56] References Cited

U.S. PATENT DOCUMENTS

| | | | |
|---|---|---|---|
| 1,833,429 | 11/1931 | Lovell et al. | 44/334 |
| 2,582,138 | 1/1952 | Lane et al. | 252/180 |
| 2,641,539 | 6/1953 | Thompson et al. | 44/73 |
| 2,918,359 | 12/1959 | Lovett et al. | 44/418 |
| 3,522,022 | 7/1970 | May et al. | 44/412 |
| 3,701,641 | 10/1972 | Rakow et al. | 44/412 |
| 3,860,430 | 1/1975 | Walker et al. | 106/4 |
| 3,989,476 | 11/1976 | Abbott | 44/334 |

FOREIGN PATENT DOCUMENTS

| | | |
|---|---|---|
| 0095972 | 12/1983 | European Pat. Off. . |
| 0294045 | 12/1988 | European Pat. Off. . |
| 3301840 | 8/1983 | Fed. Rep. of Germany . |
| 1111136 | 2/1956 | France . |

*Primary Examiner*—Jacqueline V. Howard
*Attorney, Agent, or Firm*—Wegner, Cantor, Mueller & Player

[57] ABSTRACT

An additive for liquefied hydrocarbon fuel contains a) 30–60 volume percent of at least one nitrogen-containing solvent, b) 30–60 volume percent of at least one nitrogen-containing dispersing agent, c) 0.5–10 volume percent of a nitrogen-containing corrosion inhibiting agent and d) 0.5–10 volume percent of at least one oxidation inhibitor, wherein the sum of ingredients a, b, c and d is 100 volume percent. This additive protects against corrosion, aging, separation of materials on motor parts and purification of the exhaust gas in motors using liquefied hydrocarbon fuels.

12 Claims, 1 Drawing Sheet

ADDITIVE FOR LIQUEFIED-GAS FUELS

This application is a continuation of U.S. application Ser. No. 07/556,729 filed Jul. 25, 1990, now abandoned.

Object of the invention is an additive for liquefied hydrocarbon gas fuels for corrosion protection, aging protection, prevention of deposition of crud on motor parts and cleaning of the exhaust gas from internal combustion engines driven by liquefied gas, namely gas engines.

In view of vanishing resources and increased environmental awareness, there is a great need to use as fuels for internal combustion engines not only liquid constituents of mineral oil, such as the commonly used gasoline, but to have recourse to the large existing reserves of natural gas, namely in the form of liquefied natural gas, hereinafter designated as liquefied gas or liquefied hydrocarbon fuel. The commonly available liquefied gases contain mixtures of $C_3$- and/or $C_4$-alkanes, such as propane, butane or isobutane, which are produced in oil refineries as by-products in the distillation and cracking of petroleum and also in the processing of natural gas. The constituents propane, butane and isobutane may be contained in arbitrary quantity ratios in the liquefied gas and, owing to the fact that they contain hardly any or no sulfur or nitrogen constituents, they yield only water and carbon dioxide as combustion products.

During the storage of fuels such as gasoline, diesel oil and liquefied gas and also in the storage tanks of refineries, filling stations and the motor vehicles driven by them, polymerization and oxidation reactions can occur in which resin-like or rubber-like precipitates are formed which can impair the transport of the liquefied gas through fuel lines, carburetors, injection pumps, injection nozzles and evaporators and can cause deposits in those devices. It is known that this problem with common liquid mineral-oil fuels can be attacked by adding additives, using particularly oxidation stabilizers such as long-chain fatty amines and dispersing agents, namely surface-active agents, which cause a stabilization of the insoluble components.

Thus, already known from German application DE-PS33 01 840 is an additive for liquid hydrocarbon fuels which contains an alcohol with no more than 4 carbon atoms an aliphatic ester with no more than 6 carbon atoms, an aromatic hydrocarbon, a halogenated alkene with 3 or fewer carbon atoms in the alkene chain, an aliphatic hydrocarbon with a 50% boiling point between 115° and 182° C. and a hydroxy-substituted unsaturated acid with 16 to 24 carbon atoms. This additive can be used, in particular, with gasoline and diesel oil to improve the combustion efficiency and for cleaner combustion.

The liquefied gas available from refineries contains small components of unsaturated compounds which form resin-like, lacquer-like and acidic substances which deposit throughout the liquefied-gas system and can cause corrosion. In particular, these mixtures of substances collect in the evaporator system of the liquefied-gas internal combustion engine and are solidified there because of the high temperatures and sufficiently long dwell time, and are deposited in the form of solid, hard-to-remove coatings. Furthermore, the engine fouling increases due to the aged liquefied gas in the area of the intake system, which also has an unfavorable influence on the exhaust-gas composition with respect to hydrocarbons and carbon monoxide.

For liquefied gas with its relatively low temperature which can reach −50° C. at evaporation, the additives used for normal fuels that are liquid under ambient conditions have proved unsuitable because they do not evaporate with the liquefied gas owing to their too low volatility and collect in the fuel tank.

The task addressed by the present invention is not to identify an additive for liquified gas fuels with which this problem can be solved, i.e., the formation of resin-like or rubber-like precipitates during the storage of the liquefied gas and the deposition of these products in the fuel lines, evaporator system, injection nozzles and valves can be prevented and the quality of the exhaust gas can be improved.

This task is now accomplished by the additive of the invention.

Thus, the invention relates to an additive for liquefied hydrocarbon fuels characterized by a content of a) 30 to 60 vol.-% of at least one nitrogen-containing solvent, b) 30 to 60 vol.-% of at least one nitrogen-containing dispersing agent, c) 0.5 to 10 vol.-% of at least one nitrogen-containing corrosion inhibiting agent, and d) 0.5 to 10 vol.-% of at least one oxidation inhibitor, with the condition that the sum of the constituents is 100 vol.-%.

According to a preferred embodiment of the invention, the additive contains 40 to 50 vol.-% of the nitrogen-containing solvent, 40 to 50% of the nitrogen-containing dispersing agent, 1 to 5 vol.-% of the nitrogen-containing corrosion-protection agent and 1 to 5 vol.-% of the oxidation inhibitor.

Advantageously used as nitrogen-containing solvent a) and/or as nitrogen-containing dispersing agent b) is a material having a maximum molecular weight of 120, because this ensures that these constituents do not collect in the liquefied-gas tank when the liquefied gas evaporates from that tank. The nitrogen-containing corrosion-protection agent c) and the oxidation inhibitor d) generally have higher boiling points, but are contained in the additive and specifically in the liquefied gas in such small amounts that they are entrained by the liquefied gas and also do not collect.

Besides the essential constituents a) to d), the additive according to the invention may in some circumstances contain additional constituents such as colorants, deodorants and agents to inhibit heavy metals such as copper, for example, in amounts of 0.1 to 5 wt.-% each relative to the mixture of constituents a) to d).

The additive is used either in the form of a mixture of the essential constituents or in the form of a solution in an alkanol with 1 to 4 carbon atoms, preferably with a content of 50 to 200 vol.-% of the alkanol relative to 100 vol.-% of the constituents a) to d), particularly in the form of a 1:1 solution in methanol, ethanol, propanol, isopropanol and/or butanol.

The additive according to the invention is added to the liquefied gas in an amount of 25 to 1000 ppm, preferably 50 to 400 ppm, based on the mixture of constituents a) to d).

The additive according to the invention can contain as nitrogen-containing solvent a) at least one compound selected from the group comprising formamide derivatives, thioformamide derivatives, N-alkylpyrrolidone derivatives with 1 or 2 carbon atoms in the alkyl residue, acetamide derivatives, sec.-N-alkanolamines and tert.-N-alkanolamines with 1 to 4 carbon atoms each in the alkyl residue, and nitroparaffins with 1 to 8 carbon atoms. Especially preferred for use as nitrogen-containing solvent a) are methylformamide, dimethylformamide, ethylformamide, diethylformamide, methylethylformamide, ethylpropylformamide, methylthioformamide, dimethylthioformamide, ethylthioformamide, diethylthioformamide, methylethylthioformamide, ethylpropylthioformamide, N-methyl-2-pyrrolidone, N-ethyl-2-pyrrolidone, methylacetamide, dimethylacetamide, ethylacetamide, diethylacetamide, bis(2-hydroxyethyl)amine, bis(3-hydroxypropyl)-amine, bis(4-hydroxybutyl)amine, 2-hydroxyethyl-3-hydroxypropylamine, hydroxymethyl-4-hydroxybutylamine, 2-hydroxyethyl-4-hydroxypropylamine, hydroxymethyl-4-hydroxybutylamine, 2-hydroxyethyl-4-hydroxybutylamine, tris(2-hydroxyethyl)amine, tris(3-hydroxypropyl)amine, tris(4-hydroxybutyl)amine, 2-hydroxyethyl-3-hydroxypropyl-4-hydroxybutylamine, bis(2-hydroxyethyl)-3-hydroxypropylamine, nitromethane, nitroethane, nitropropane, nitrobutane, nitropentane, nitrohexane, nitroheptane and nitrooctane, as well as the nitro derivative of the corresponding isomers of these compounds.

As nitrogen-containing dispersing agent b) the claimed additive preferably contains morpholine, morpholine derivatives, thiomorpholine, thiomorpholine derivatives and cyclohexylamine. Examples of morpholine derivatives are N-methylmorpholine, N-ethylmorpholine, N-propylmorpholine, N-formylmorpholine, N-acetylmorpholine, N-propionylmorpholine, N-methylthiomorpholine, N-ethylthiomorpholine, N-formylthiomorpholine and N-acetylthiomorpholine. More highly preferred nitrogenous solvents a) are dimethylformamide and dimethylacetamide. Morpholine is especially preferred according to the invention.

As nitrogen-containing corrosion-protection agent c) the claimed additive can contain primary, secondary and tertiary alkylamines with 6 to 14 carbon atoms in the alkyl groups and alkylene diamines with 3 to 6 carbon atoms in the alkyl residue. Especially preferred are primary tert.-alkylamines with 12 to 14 carbon atoms in the alkyl residues, as well as propylenediamine, ethylenediamine and hexylenediamine.

As nitrogen-containing oxidation inhibitor d) the additive of the invention can preferably contain representatives from the group comprising diphenylamine, alkyldiphenylamine derivatives with 3 to 6 carbon atoms in the alkyl residue, thiodiphenylamine, alkylthiodiphenylamine derivatives with 3 to 6 carbon atoms in the alkyl residue, diaminobenzene derivatives and diaminoalkylbenzene derivatives with 3 to 8 carbon atoms in the alkyl residue, alkylphenol derivatives, namely 2,4,6-tri-tert.-butylphenol, 2,4-di-tert.-butylphenol, 2-tert.-butylphenol or mixtures thereof, as well as 2,4,5-tri-tert.-octylphenol, and alkylsalicylates with 3 to 6 carbon atoms in the alkyl group.

The nitrogen-containing solvent a) used according to the invention causes the dissolution of the insoluble oxidation products which may be formed and prevents their deposition on the surfaces coming into contact with the liquefied gas.

The nitrogen-containing dispersing or wetting agent b) keeps the impurities which may be present that are not soluble or only colloidally soluble in the suspended state or in the form of an emulsion, influences the surface tension, promotes combustion and effects a vapor-phase corrosion protection. The nitrogen-containing corrosion-protection agent c) prevents corrosion of the surfaces coming into contact with the liquefied gas by means of cation activity at the surfaces and by means of bonding of oxygen, carbon dioxide and moisture and neutralization of acid groups such as, for example, sulfate groups or reactive functional groups.

The oxidation inhibitor d) serves to suppress polycondensation and polymerization of the components present in the liquefied gas with double bonding and multiple double bonding.

It has been shown that the combination of active constituents a) to d) according to the invention exerts a synergetic effect in which not only is corrosion of metal parts in contact with the liquefied gas prevented and deposition of resin-like deposits in the evaporator and in the valves of the internal-combustion engine prevented, but also an unexpectedly clear improvement of the exhaust-gas composition is achieved.

The following example serves to further explain the invention and to demonstrate this fact. The invention shall be explained in more detail in the following with references to the following example and the appended drawing in which:

EXAMPLE

An additive is formed by mixing the following constituents:

44.5 vol.-% dimethylformamide 47.5 vol.-% morpholine 4.0 vol.-% of a mixture of primary alkylamines with 12 to 14 carbon atoms in the alkyl residue (Primene 18-R) and 4.0 vol.- % of a mixture of 75% 2,6-di-tert.-butylphenol and 25% of a mixture of 2,4,6-tri-tert.-butylphenol, 2,4-di-tert.-butylphenol and 2-tert.-butylphenol.

This additive mixture is added to a commercial liquefied gas in an amount of 250 ppm. A test engine based on Euro-Standard CECT-02-T79 is driven with the liquefied gas treated with the additive in this manner. Even after a 40-hour engine run, no deposits at all can be found on the surfaces of the evaporator or on the valve disks.

The composition of the exhaust gas was measured during operation in regard to the content of carbon monoxide (CO in vol.-%) and hydrocarbons (HC in ppm). During the measurements the oil temperature was held constant at 90° C. and the coolant temperature at a value of between 92° and 96° C.

The results obtained are compiled in the following table:

| Exhaust-gas state after 40 hours of running time | | CO vol. % | HC ppm |
|---|---|---|---|
| Without additive | 1100 rpm | 0.38 | 225 |
| Without additive | 3000 rpm | 0.10 | 15 |

-continued

| Exhaust-gas state after 40 hours of running time | | CO vol. % | HC ppm |
|---|---|---|---|
| With additive | 1100 rpm | 0.20 | 145 |
| With additive | 3000 rpm | 0.08 | 0 |

Figure 1:
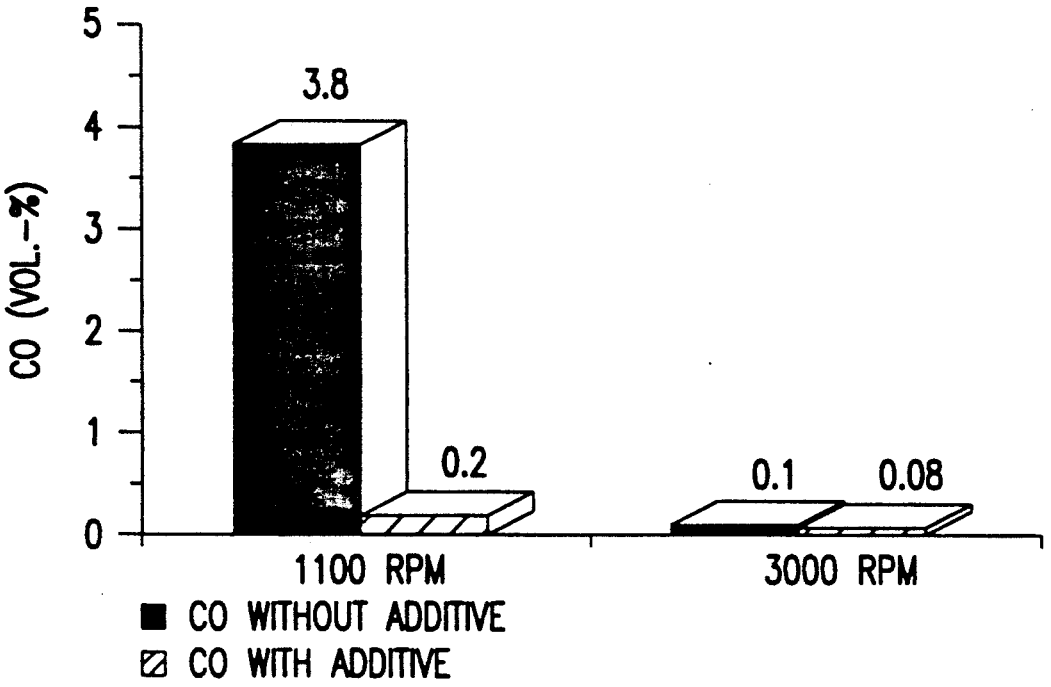
FIG. 1 shows the effect of the additive according to the invention on the CO content of the exhaust gas of an internal-combustion engine driven with a liquefied gas and FIG. 2 shows the effect of the additive according to the invention on the hydrocarbon (HC) content of the exhaust gas of an internal-combustion engine driven with a liquefied gas.
Figure 2:
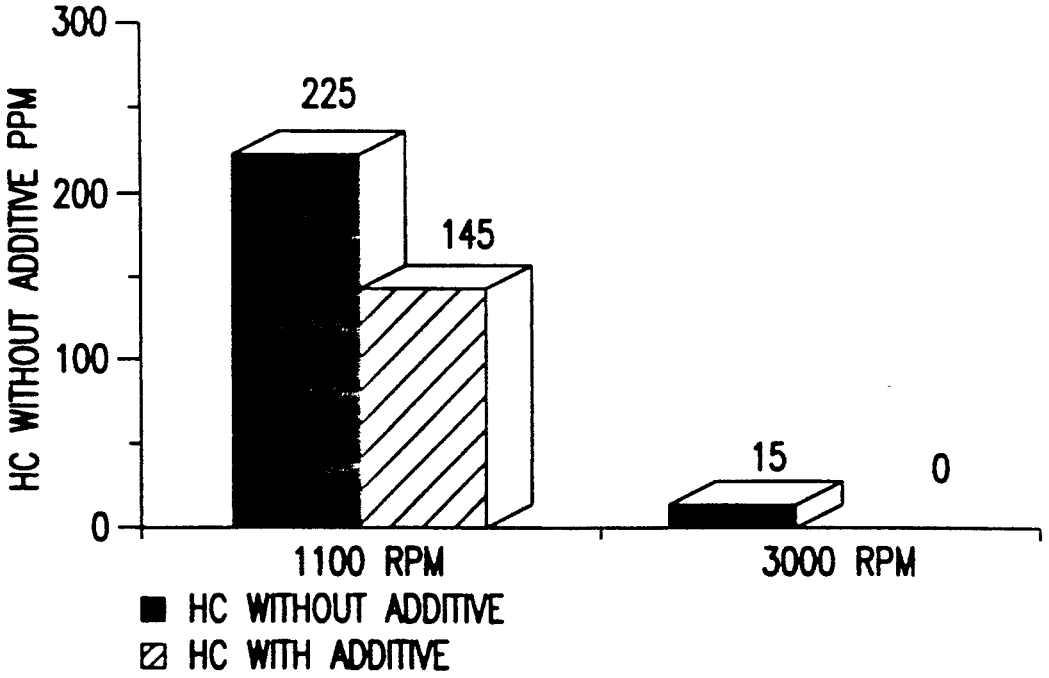

A graphical representation of these results is shown in the drawing. FIG. 1 shows the influence of the additive according to the invention on the CO content of the exhaust gas and FIG. 2 shows the influence of the additive according to the invention on the hydrocarbon content of the exhaust gas. As can be seen, there is a surprising improvement of the exhaust-gas composition when the additive according to the invention is used.

Upon further investigation it was found that, comparing the liquefied gas containing additive with the liquefied gas containing no additive after 48 hours of storage, clouding is prevented and corrosion due to contact with a liquefied gas having a content of 0.1% water and a pH of 5.0 is prevented.

What is claimed is:

1. A method of imparting corrosion-resistent properties to a liquefied gaseous hydrocarbon fuel comprising adding to the fuel at 50 to 400 ppm, an additive comprising:

a) 30–60 volume percent of at least one nitrogen-containing solvent selected from the group consisting of formamide derivatives, thioformamide derivatives, N-alkyl-pyrrolidone derivatives with one or two carbon atoms in the alkyl residue, acetamide derivatives, secondary N-alkanolamines, tertiary N-alkanolamines each of 1–4 carbon atoms in the alkyl residue and nitro paraffins of 1–8 carbon atoms, b) 30–60 volume percent of at least one nitrogen-containing dispersing agent selected from the group consisting of morpholine, morpholine derivatives, thiomorpholine, thiomorpholine derivatives and cyclohexylamine, c) 0.5–10 volume percent of a nitrogen-containing corrosion inhibiting agent selected from the class consisting of primary, secondary and tertiary $C_{6-14}$-alkylamines and $C_{3-6}$-alkylenediamines and d) 0.5–10 volume percent of at least one oxidation inhibitor, wherein the sum of ingredients a, b, c and d is 100 volume percent.

2. The method of claim 1, containing a) 40–50 volume percent of at least one nitrogen-containing solvent, b) 40–50 volume percent of at least one nitrogen-containing dispersing agent, c)1–5 volume percent of at least one nitrogen-containing corrosion inhibiting agent and d) 1–5 volume percent of at least one oxidation inhibitor.

3. The method of claim 1, wherein the nitrogen-containing solvent has a molecular weight no greater than 120.

4. The method of claim 1, wherein the nitrogen-containing dispersing agent has a maximum molecular weight no greater than 120.

5. The method of claim 1, wherein the nitrogen-containing solvent a) is selected from the group consisting of methylformamide, dimethylformamide, ethylformamide, diethylformamide, methylethylformamide, ethylpropylformamide, methylthioformamide, dimethylthioformamide, ethylthioformamide, diethylthioformamide, methyl-ethylthioformamide, ethyl-propylthioformamide, N-methyl-2-pyrrolidone, N-ethyl-2-pyrrolidone, methylacetamide, dimethylacetamide, ethylacetamide, diethylacetamide, bis(2-hydroxyethyl)-amine, bis(3-hydroxypropyl)amine, bis(4-hydroxybutyl)amine, 2-hydroxyethyl-3-hydroxypropylamine, hydroxymethyl-4-hydroxybutylamine, 2-hydroxyethyl-4-hydroxybutyl amine, tris(2-hydroxyethyl)amine, tris(3-hydroxypropyl)amine, tris(4-hydroxybutyl)-amine, 2-hydroxyethyl-3-hydroxypropyl-4-hydroxybutylamine, bis(2-hydroxyethyl)-3-hydroxypropylamine and $C_{1-8}$-nitroalkanes.

6. The method of claim 1, wherein the dispersing agent b) is at least one member of the class consisting of N-methylmorpholine, N-ethylmorpholine, N-propylmorpholine, N-formylmorpholine, N-acetylmorpholine, N-propionylmorpholine, N-methyl-thiomorpholine, N-ethylthiomorpholine, N-formylthiomorpholine, and N-acetylthiomorpholine.

7. The method of claim 1, wherein the nitrogen-containing corrosion inhibiting agent c) contains at least one primary $C_{12-14}$-tert-alkylamine, propylendiamine, ethylendiamine or hexylendiamine.

8. The method of claim 1, wherein the oxidation inhibitor d) contains at least one member of the group consisting of diphenylamine, ($C_{3-6}$-alkyl)-diphenylamine, thiodiphenylamine, ($C_{3-6}$-alkyl)-thiodiphenylamine, diaminobenzene and diaminoalkylbenzene derivatives with 3–8 carbon atoms in the alkyl group, 2,4,6-tri-tert-butylphenol, 2,4-di-tert-butylphenol, 2-tert-butylphenol, 2,4,6-tri-tert-octylphenol and ($C_{3-6}$-alkyl)salicylates.

9. The method of claim 1, wherein the additive comprises in addition to the mixture of a), b), c) and d) defined as in claim 1, amounts of 0.1 to 5 percent by weight of additional substances of the class consisting of dyes, odor improving agents and heavy metal inhibitors.

10. The method of claim 1, wherein the additive comprises in addition to 100 volume percent of the total of ingredients of a), b), c), and d) defined in claim 1, 50 to 200 volume percent of a $C_{1-4}$-alkanol as a solvent.

11. The product made according to the method of claim 1.

12. The method of claim 1 wherein the liquefied gaseous hydrocarbon fuel is liquefied natural gas.

* * * * *